US008503684B2

(12) United States Patent
Lien et al.

(10) Patent No.: US 8,503,684 B2
(45) Date of Patent: Aug. 6, 2013

(54) MULTI-CHANNEL AUDIO SIGNAL DECODING METHOD AND DEVICE

(75) Inventors: Chu-Feng Lien, Hsinchu Hsien (TW); Wei Jan Wang, Hsinchu Hsien (TW)

(73) Assignee: MStar Semiconductor, Inc., Hsinchu Hsein (TW)

( * ) Notice: Subject to any disclaimer, the term of this patent is extended or adjusted under 35 U.S.C. 154(b) by 433 days.

(21) Appl. No.: 12/795,838

(22) Filed: Jun. 8, 2010

(65) Prior Publication Data

US 2010/0310081 A1 Dec. 9, 2010

(30) Foreign Application Priority Data

Jun. 8, 2009 (TW) ..... 98119112 A

(51) Int. Cl.
*H04R 5/00* (2006.01)

(52) U.S. Cl.
USPC ..... 381/22

(58) Field of Classification Search
USPC ..... 381/19–23
See application file for complete search history.

(56) References Cited

U.S. PATENT DOCUMENTS

| | | | | |
|---|---|---|---|---|
| 6,076,062 | A * | 6/2000 | Van Steenbrugge | 704/500 |
| 2007/0223708 | A1* | 9/2007 | Villemoes et al. | 381/17 |
| 2008/0304678 | A1* | 12/2008 | Chen et al. | 381/71.12 |
| 2009/0028344 | A1* | 1/2009 | Pang et al. | 381/1 |
| 2011/0305352 | A1* | 12/2011 | Villemoes et al. | 381/98 |

OTHER PUBLICATIONS

Oppenheim et al., Discrete-time Signal Processing; 1989, p. 105-p. 111.*

* cited by examiner

*Primary Examiner* — Ping Lee
(74) *Attorney, Agent, or Firm* — WPAT, PC; Justin King

(57) ABSTRACT

A multi-channel audio signal decoding method and device is provided. The multi-channel audio signal decoding method includes receiving a first multi-channel audio signal; performing a first decoding procedure on the first multi-channel audio signal to generate a second multi-channel audio signal; performing a second decoding procedure on a first single-channel audio data of the second multi-channel audio signal to generate a first single-channel audio signal when the first single-channel audio data belongs to a first classification; and performing a third decoding procedure on a second single-channel audio data of the second multi-channel audio signal to generate a second single-channel audio signal when the second single-channel audio data belongs to a second classification. The number of instructions of the third decoding procedure is less than that of the second decoding procedure.

12 Claims, 5 Drawing Sheets

MULTI-CHANNEL AUDIO SIGNAL DECODING METHOD AND DEVICE

CROSS REFERENCE TO RELATED PATENT APPLICATION

This patent application is based on Taiwan, R.O.C. patent application No. 098119112 filed on Jun. 8, 2009.

FIELD OF THE INVENTION

The present invention relates to an audio signal decoding method and device, and more particularly, to a multi-channel audio signal decoding method applied to a playback system and a device thereof.

BACKGROUND OF THE INVENTION

In order to reduce data amount of digital audio signals, many data compression methods are developed. For example, the Advanced Audio Coding (AAC) technology is matured quite quickly and is widely used. Moreover, the High Efficiency Advanced Audio Coding (HE-AAC) is emerged to pursue lower bit rates and higher audio quality. The HE-AAC technology mainly based on the AAC technology implements a spectral band replication (SBR) to obtain extremely high compression efficiency and reduce bit-rate by about 30% as well, so as to keep high audio quality at lower bit-rate.

Refer to FIG. 1A showing a functional block diagram of a conventional decoder using the HE-AAC technology. For example, an audio signal to be decoded has an original sampling frequency of fs and an audio frequency range of 0 to fa. The audio signal to be decoded is processed by an AAC decoder 10 to generate a pulse code modulation (PCM) signal with a sampling frequency fs/2. The PCM signal is transmitted to a high-efficiency module 11. A quadrature mirror filter (QMF) banks analyzer 111 of the high-efficiency module 11 demodulates and analyzes the PCM signal to generate a low-frequency band audio data having a frequency band range of 0 to fa/2 in the frequency domain and a group of coefficients representing a high-frequency band audio data having a frequency band range of fa/2 to fa. The low-frequency band audio data and the group of coefficients representing the high-frequency band audio data are transmitted to an SBR module 112 for performing SBR. After passing the low-frequency band audio data and the high-frequency band data through a combining module 113 and a QMF banks synthesizer 114, a PCM signal with a sampling frequency fs is restored.

A surround audio effect is essential in a current audio-visual playback system. A multi-channel digital audio signal capable of providing the surround effect has various formats such as the common 5.1-channel format. With respect to the 5.1-channel format, audio signals from six channels are encoded into a multi-channel digital audio signal to be stored and transmitted. After decoding the multi-channel digital audio signal into the audio signals of the six channels, with reference to FIG. 1B, the playback system applies a pair of front speakers L and R, a center speaker C, a pair of rear surround speakers RL and RR, and a bass speaker Sub to play the audio signals. For example, the front speakers L and R serve as a main channel for providing a front sound field. The center speaker C presents dialogs of a film, the rear surround speakers RL and RR provide complete sound field envelopment, and the bass speaker Sub provides a low-frequency audio output.

The HE-AAC 5.1 audio technology, combining the foregoing two technologies, is prevailing in digital video disks (DVD), digital broadcasting and digital televisions. In a conventional decoding method, the audio signal to be decoded is transmitted to a decoder as shown in FIG. 1A. The QMF banks analyzer 111, the SBR module 112, the combining module 113 and the QMF banks synthesizer 114 need to decode the audio signal six times to restore the audio signals, belonging to the six channels, to be played, such that a large amount of calculation needed by the above process inevitably impose a burden on the playback system. Therefore, one main object of the present invention is to overcome the foregoing disadvantage.

SUMMARY OF THE INVENTION

A multi-channel audio signal decoding method applied to a playback system is provided according to the present invention. The method comprises receiving a first multi-channel audio signal; performing a first decoding procedure on the first multi-channel audio signal to generate a second multi-channel audio signal; performing a second decoding procedure on a first single-channel audio data of the second multi-channel audio signal to generate a first single-channel audio signal when the first single-channel audio data belongs to a first classification; and performing a third decoding procedure for a second single-channel audio data of the second multi-channel audio signal to generate a second single-channel audio signal when the second single-channel audio data belongs to a second classification. The number of instructions of the third decoding procedure is less than that of the second decoding procedure. Preferably, the first multi-channel audio signal is an HE-AAC 5.1 audio signal, the first decoding procedure applies an AAC decoder, and the multi-channel audio signal is a six-channel PCM signal. Preferably, the first classification comprises the audio data of a left channel, a right channel, a rear-left channel and a rear-right channel; the second classification comprises the audio data of a center channel and a bass channel. Whether the HE-AAC 5.1 audio signal to be decoded belongs to the first classification or the second classification is determined by parsing a header of each frame of the HE-AAC 5.1 audio signal.

According to the foregoing structure, the second decoding procedure of the multi-channel audio signal decoding method according to the present invention comprises demodulating and analyzing the first single-channel audio data to generate a low-frequency band audio data and a plurality of coefficients representing a high-frequency band audio data; performing SBR for the low-frequency band audio data and the coefficients representing the high-frequency band audio data to generate a high-frequency band audio data; combining the low-frequency band audio data and the high-frequency audio data into a combined audio data; and synthesizing the combined audio data to restore the first single-channel audio signal.

According to the foregoing structure, the third decoding procedure of the multi-channel audio signal decoding method according to the present invention comprises generating an upsampling signal by adding a plurality of zero values between sampling points of the second single-channel audio data; and performing a low-pass filtering on the upsampling signal to remove high-frequency components of the signal to generate the second single-channel audio signal.

According to the foregoing structure, the second single-channel audio data of the multi-channel audio signal decoding method according to the present invention is a low-frequency audio data with a predetermined frequency range. The third decoding procedure processes the low-frequency audio data with the predetermined frequency range to remove high-frequency coefficients and data of the second single-channel audio data.

A multi-channel audio signal decoding device is provided according to another aspect of the present invention. The multi-channel audio signal decoding device comprises a decoder, a high-efficiency module and a low-frequency module. The decoder receives a first multi-channel audio signal and performs a first decoding procedure on the first multi-channel audio signal to generate a second multi-channel audio signal. The high-efficiency module coupled to the decoder performs a second decoding procedure on a first single-channel audio data, belonging to a first classification, of the second multi-channel audio signal, to generate a first single-channel audio signal. The low-frequency module coupled to the decoder performs a third decoding procedure on a second single-channel audio data, belonging to a second classification, of the second multi-channel audio signal, to generate a second single-channel audio signal. The number of instructions of the third decoding procedure is less than that of the second decoding procedure. Preferably, the first multi-channel audio signal is an HE-AAC 5.1 audio signal, and the decoder is an AAC decoder. The multi-channel audio signal is a six-channel PCM signal. The first classification comprises audio data of a left channel, a right channel, a rear-left channel and a rear-right channel, and the second classification comprises audio data of a center channel and a bass channel. The decoder determines whether the HE-AAC 5.1 audio signal to be decoded belongs to the first classification or the second classification by parsing a header of each frame of the HE-AAC 5.1 audio signal. Preferably, the high-efficiency module comprises a quadrature mirror filter banks analyzer, an SBR module, a combining module, and a quadrature mirror filter banks synthesizer. The quadrature mirror filter banks analyzer coupled to the decoder demodulates and analyzes the first single-channel audio data to generate a low-frequency band audio data and a group of coefficients representing a high-frequency band audio data in the frequency domain. The SBR module coupled to the quadrature mirror filter banks analyzer performs SBR for the low-frequency band audio data and the coefficients of the high-frequency band audio data to generate a high-frequency band audio data. The combining module coupled to the quadrature mirror filter banks analyzer and the SBR module combines the low-frequency band audio data and the high-frequency band audio data. The quadrature mirror filter banks synthesizer coupled to the combining module synthesizes the low-frequency band audio data and the high-frequency band audio data to restore the first single-channel audio signal.

According to the foregoing structure, the low-frequency module of the multi-channel audio signal decoding device according to the present invention comprises an upsampler/interpolater and low pass filter. The upsampler coupled to the decoder interpolates sampling points of value 0 between sampling points of the second single-channel audio data to generate an upsampling signal. The coupled to the low pass filter upsampler performs a low-pass filtering for the sampling point added signal to remove high-frequency components of the signal, thereby generating the second single-channel audio signal.

According to the foregoing structure, the low-frequency module of the multi-channel audio signal decoding device according to the present invention processes a low-frequency audio data, having a predetermined frequency range, of the second single-channel audio data. The decoder transmits the low-frequency audio data having the predetermined frequency range to the low-frequency module and discards high-frequency coefficients and data of the second single-channel audio data.

BRIEF DESCRIPTION OF THE DRAWINGS

Following description and figures are disclosed to gain a better understanding of the advantages of the present invention.

DETAILED DESCRIPTION OF THE PREFERRED EMBODIMENT

Figure 1A:
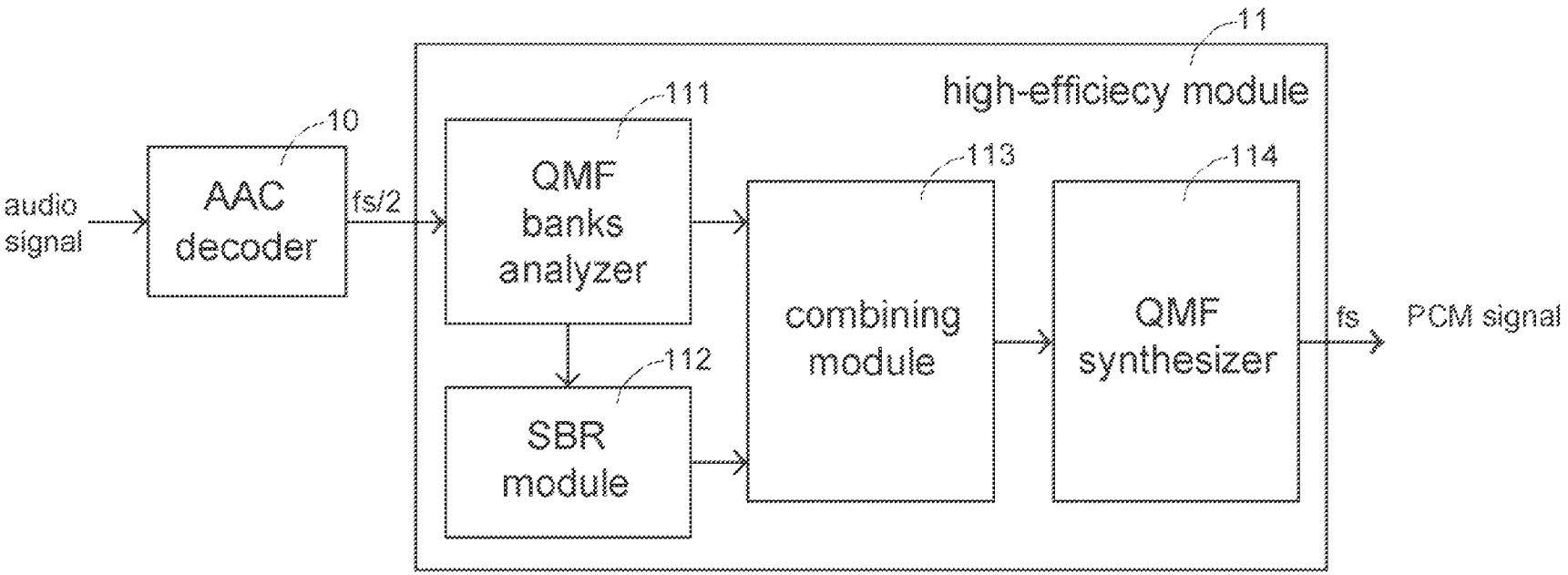
FIG. 1A (Prior Art)
FIG. 1A is a block diagram of a conventional HE-AAC decoder.
Figure 1B:
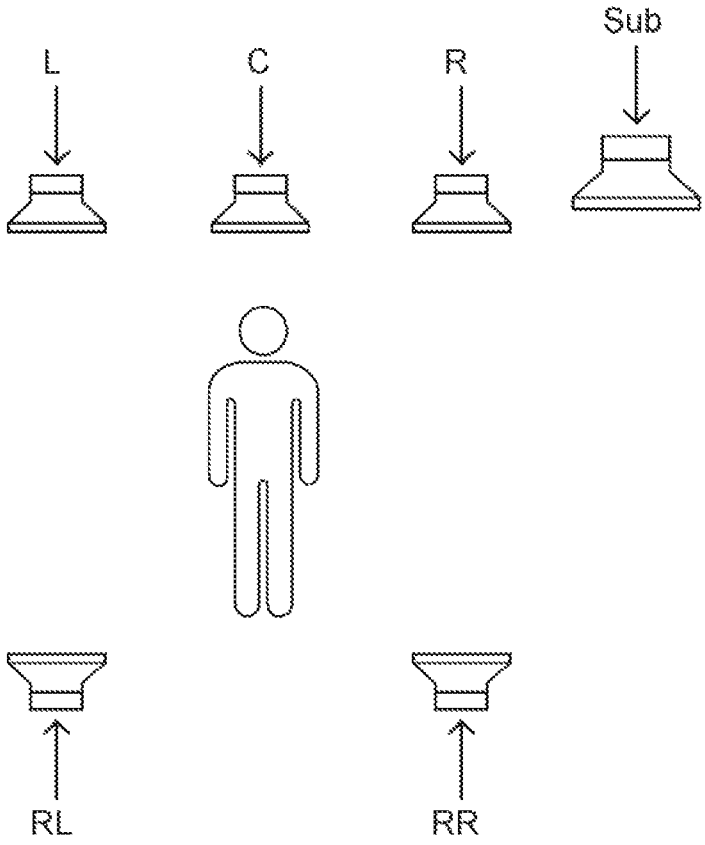
FIG. 1B (Prior Art)
FIG. 1B is a block diagram of a 5.1 channel speaker.
Figure 2:
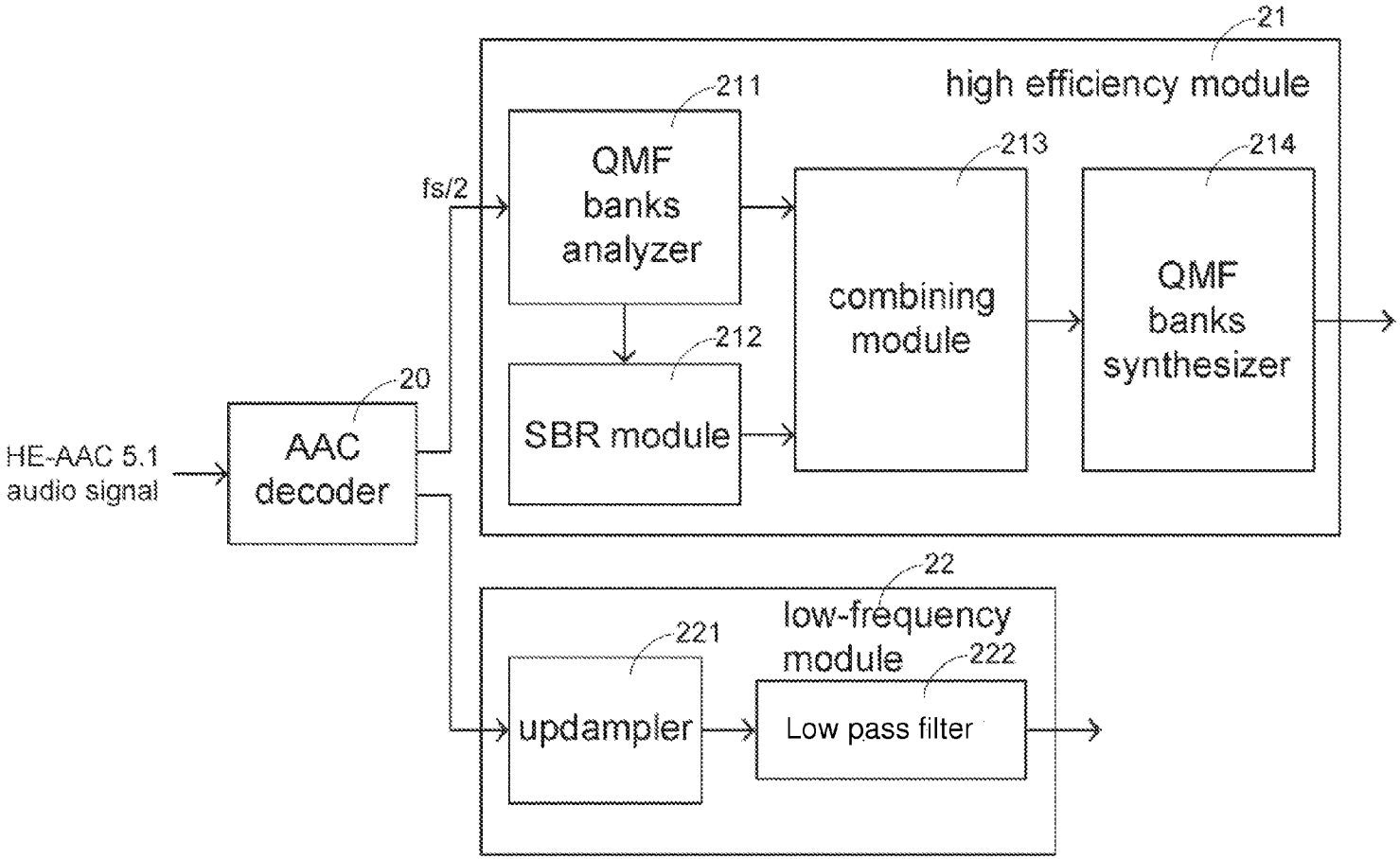
FIG. 2 is a block diagram of an HE-AAC multi-channel decoder in accordance with an embodiment of the present invention to improve the conventional technology.

Refer to FIG. 2 showing a block diagram of a HE-AAC 5.1 decoder in accordance with an embodiment of the present invention. After an HE-AAC 5.1 audio signal is processed by an AAC decoder 20, a PCM signal comprising six channels, with a sampling frequency fs/2, is generated. A plurality of audio data comprising a left channel, a right channel, a rear-left channel and a rear-right channel are transmitted to a high-efficiency module 21. A QMF banks analyzer 211 of the high-efficiency module 21 demodulates and analyzes the plurality of audio data to generate a low-frequency band audio data with a frequency range of 0 to fa/2 in the frequency domain and a group of coefficients representing a high-frequency band audio data. The low-frequency band audio data and the group of coefficients representing the high-frequency band audio data are transmitted to an SBR module 212 for performing an SBR, so as to generate a high-frequency band audio data. A combining module 213 and a QMF banks synthesizer 214 combine and synthesize the low-frequency band audio data and the high-frequency band audio data to restore the PCM signal, which belongs to the left channel, the right channel, the rear-left channel and the rear-right channel and has a sampling frequency fs.

A center channel and a bass channel from the six channels respectively provide dialogs of a film and a low frequency audio effect. Compared to a middle point fa/2 about 12 KHz of a total audio frequency range upper limit fa about 24 KHz, the dialogs and the low frequency effect have lower upper limits of 8 KHz and 200 Hz, respectively. Therefore, in this embodiment, the center channel and the bass channel, instead of being transmitted to the QMF banks analyzer 211 of the high-efficiency module 21, the SBR 212, the combining module 213 and the QMF banks synthesizer 214 for the complicated decoding calculation, is processed by simplified calculations of lower calculation amount. Accordingly, the AAC decoder 20 parses a header of each frame of the HE-AAC 5.1 audio signal to be decoded. When it is determined that a plurality of frames belong to the center channel or the bass channel, the frames are transmitted to a low-frequency module 22. For example, the AAC decoder 20 transmits a low-frequency audio data with a predetermined frequency range to the low-frequency module 22 for processing, in which high-frequency coefficients and/or data are discarded. Next, the audio data associated with the center channel and the bass channel are interpolated, so as to reduce a burden on the system by eliminating the complicated decoding calculation performed by the high-efficiency module 21.

Figure 3A:
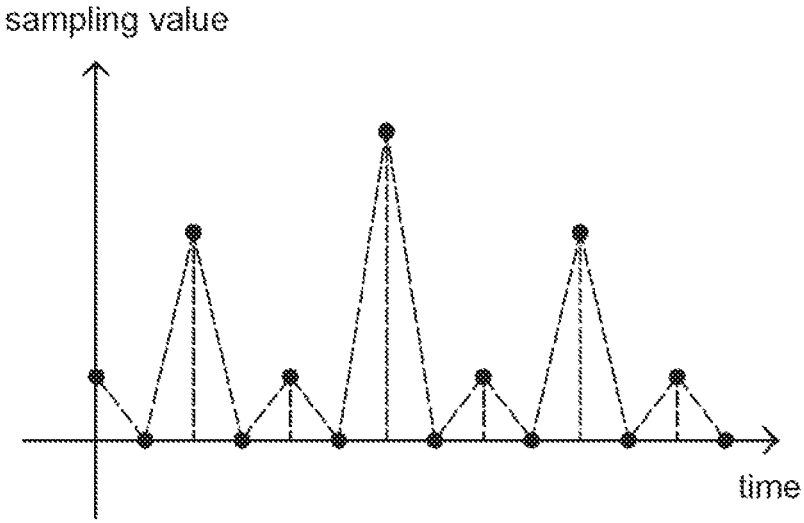
FIG. 3A is a upsampling waveform diagram with a sampling frequency fs.
Figure 3B:
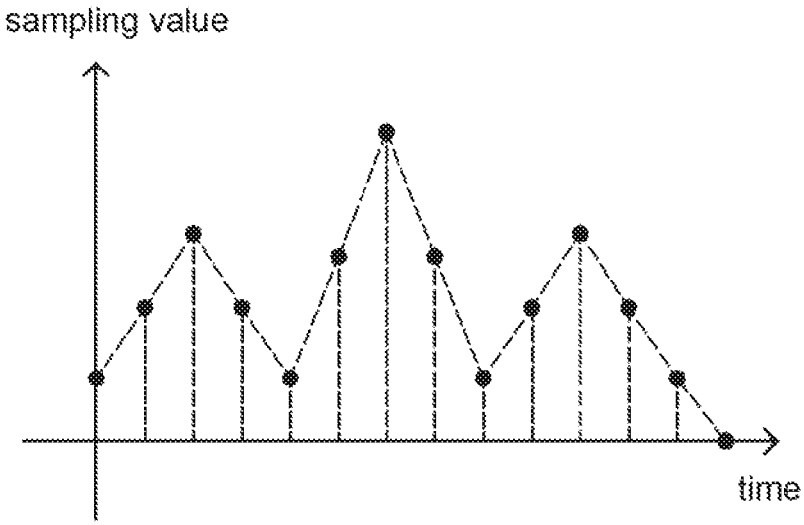
FIG. 3B is a filtered waveform of a PCM signal with a sampling frequency fs.

Referring to FIG. 2, the low-frequency module 22 comprises an upsampler 221 and an low pass filter 222. A center channel and bass channel signal with a sampling frequency fs/2 enter the upsampler 221. The upsampler 211 inserts zero values between sampling points of the signal, so as to produce a waveform diagram of an upsampling signal with a sampling frequency fs as shown in FIG. 3A. The upsampling signal enters the low pass filter 222, for removing high-frequency components of the upsampling signal to generate a PCM signal. Refer to FIG. 3B showing a filtered waveform diagram of the PCM signal, associated with the center channel and the low frequency effect channel, with a sampling frequency fs. The foregoing high-efficiency module 21 and the low-frequency module 22 can be implemented by a digital signal processor (DSP).

Figure 4:
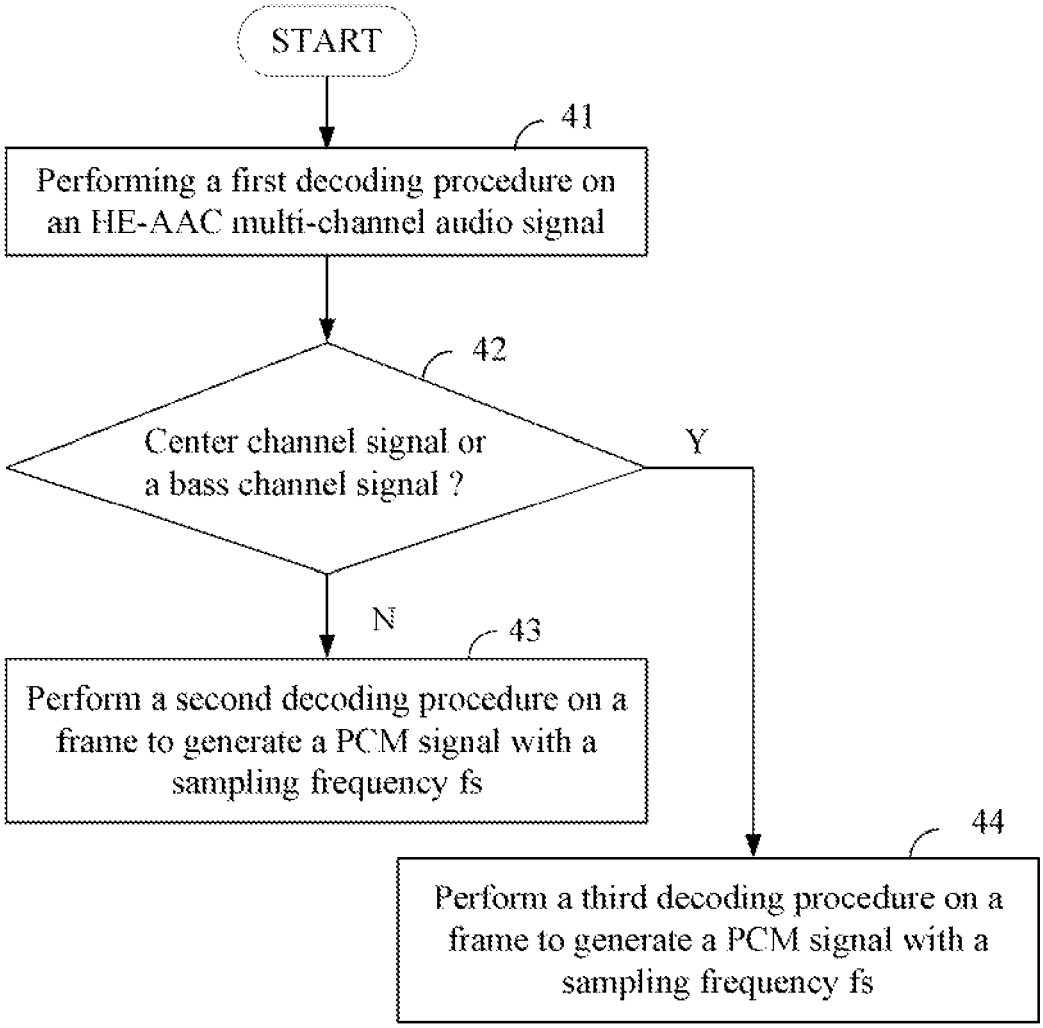
FIG. 4 is a flowchart of a multi-channel digital audio signal decoding method according to an embodiment of the present invention.

Refer to FIG. 4 showing a flowchart of a multi-channel digital audio signal decoding method according to an embodiment of the present invention. In Step 41, a first decoding procedure is performed by an AAC decoder 20 on an HE-AAC multi-channel audio signal to be decoded, and a PCM signal, with a sampling frequency fs/2, is decoded. In Step 42, a header of a frame of the HE-AAC multi-channel audio signal to be decoded is parsed to determine whether the frame associates with a center channel signal or a bass channel signal. When the answer of Step 42 is no, Step 43 is performed. In Step 43, the frame is transmitted to a high-efficiency module 21 to perform a second decoding procedure to generate a PCM signal with a sampling frequency fs. When the answer of Step 42 is yes, Step 44 is performed. In Step 44, the frame is transmitted to a low-frequency module 22 to perform a third decoding procedure, so as to generate a PCM signal with the sampling frequency fs, thereby reducing a burden on a system.

Comparing the high-efficiency module 21 with the low-frequency module 22 in FIG. 2, a same DSP is used for processing a same signal. In contrast to the number of million instructions per second (MIPS) of the second decoding procedure performed by the high-efficiency module 21, the number of MIPS of the third decoding procedure performed by the low-frequency module 22 is reduced by approximately 30 MIPS.

To sum up, a multi-channel audio signal decoding method and device according to the present invention can effectively reduce hardware complexity and cost of a multi-channel digital audio signal playback system, and the multi-channel audio signal decoding method and device can be widely implemented in DVDs, digital broadcasting receivers and digital televisions. While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A multi-channel audio signal decoding method, applied to a playback system, comprising:

receiving a first multi-channel audio signal;

performing a first decoding procedure on the first multi-channel audio signal to generate a second multi-channel audio signal, wherein the first decoding procedure is performed by an AAC decoder, and the second multi-channel audio signal is a six-channel pulse code modulation (PCM) signal;

performing a second decoding procedure on a first single-channel audio data of the second multi-channel audio signal to generate a first single-channel audio signal; and performing a third decoding procedure on a second single-channel audio data of the second multi-channel audio signal to generate a second single-channel audio signal, wherein a number of instructions of the third decoding procedure is less than that of the second decoding procedure;

wherein the third decoding procedure comprises:

producing an upsampling signal by adding a plurality of zero values between sampling points of the second single-channel audio data; and performing a low-pass filtering on the upsampling signal to generate the second single-channel audio signal.

2. The multi-channel audio signal decoding method as claimed in claim 1, wherein the first multi-channel audio signal is a High Efficiency Advanced Audio Coding (HE-AAC) 5.1 audio signal.

3. The multi-channel audio signal decoding method as claimed in claim 1, wherein the second decoding procedure comprises:

demodulating the first single-channel audio data to generate a low-frequency band audio data and a plurality of coefficients representing a high-frequency band audio data in a frequency domain;

performing a spectral band replication (SBR) on the low-frequency band audio data and the coefficients representing the high-frequency band audio data to generate a high-frequency audio data;

combining the low-frequency band audio data and the high-frequency audio data into a combined audio data; and synthesizing the combined audio data to restore the first single-channel audio data.

4. The multi-channel audio signal decoding method as claimed in claim 1, wherein the first single-channel audio data represents audio data of a left channel, a right channel, a rear-left channel or a rear-right channel, the second single-channel audio data represents audio data of a center channel or a bass channel.

5. The multi-channel audio signal decoding method as claimed in claim 1, wherein the second single-channel audio data is a low-frequency audio data with a predetermined frequency range.

6. The multi-channel audio signal decoding method as claimed in claim 5, wherein the third decoding procedure processes the low-frequency audio data with the predetermined frequency range and discarding a plurality of high-frequency coefficients associated with the second single-channel audio data to generate the second single-channel audio signal.

7. A multi-channel audio signal decoding device, comprising:

a decoder, for receiving a first multi-channel audio signal and performing a first decoding procedure on the first multi-channel audio signal to generate a second multi-channel audio signal, wherein the decoder is an AAC decoder, and the second multi-channel audio signal is a six-channel PCM signal;

a high-efficiency module, coupled to the decoder, for performing a second decoding procedure on a first single-channel audio data of the second multi-channel audio signal to generate a first single-channel audio signal; and a low-frequency module, coupled to the decoder, for performing a third decoding procedure on a second single-channel audio data of the second multi-channel audio signal to generate a second single-channel audio signal, comprising:

an upsampler, coupled to the decoder, for producing an upsampling signal by adding a plurality of zero values between sampling points of the second single-channel audio data; and an interpolation filter, coupled to the upsampler, for performing a low-pass filtering on the upsampling signal to generate the second single-channel audio signal;

wherein, a number of instructions of the third decoding procedure is less than that of the second decoding procedure.

8. The multi-channel audio signal decoding device as claimed in claim 7, wherein the first multi-channel audio signal is an HE-AAC 5.1 audio signal.

9. The multi-channel audio signal decoding device as claimed in claim 7, wherein the high-efficiency module comprises:

a quadrature mirror filter banks analyzer, coupled to the decoder, for demodulating and analyzing the first single-channel audio data to generate a low-frequency band audio data and a plurality of coefficients representing a high-frequency band audio data in a frequency domain;

an SBR module, coupled to the quadrature mirror filter banks analyzer, for performing SBR on the low-frequency band audio data and the coefficients representing the high-frequency band audio data to generate a high-frequency band audio data;

a combining module, coupled to the quadrature mirror filter banks analyzer and the SBR module, for combining the low-frequency band audio data and the high-frequency band audio data into a combined audio data; and a quadrature mirror filter banks synthesizer, coupled to the combining module, for synthesizing the combined audio data to restore the first single-channel audio data.

10. The multi-channel audio signal decoding device as claimed in claim 7, wherein the first single-channel audio data represents audio data of a left channel, a right channel, a rear-left channel or a rear-right channel, and the second single-channel audio data represents audio data of a center channel or a bass channel.

11. The multi-channel audio signal decoding device as claimed in claim 7, wherein the low-frequency module processes a low-frequency audio data of the second single-channel audio data within a predetermined frequency range.

12. The multi-channel audio signal decoding device as claimed in claim 11, wherein the decoder transmits the low-frequency audio data within the predetermined frequency range and discards a plurality of high-frequency coefficients of the second single-channel audio data.

* * * * *